US008393512B2

(12) United States Patent
Tanimoto et al.

(10) Patent No.: US 8,393,512 B2
(45) Date of Patent: Mar. 12, 2013

(54) FASTENER DRIVING TOOL

(75) Inventors: Hideyuki Tanimoto, Hitachinaka (JP); Toshihito Sakaba, Hitachinaka (JP); Hiroyuki Oda, Hitachinaka (JP); Yoshihiro Nakano, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 393 days.

(21) Appl. No.: 12/526,787

(22) PCT Filed: Mar. 25, 2008

(86) PCT No.: PCT/JP2008/056269

§ 371 (c)(1),
(2), (4) Date: Aug. 12, 2009

(87) PCT Pub. No.: WO2008/123482

PCT Pub. Date: Oct. 16, 2008

(65) Prior Publication Data

US 2010/0102104 A1 Apr. 29, 2010

(30) Foreign Application Priority Data

Mar. 26, 2007 (JP) ..... P2007-078977

(51) Int. Cl.
*B25C 1/06* (2006.01)

(52) U.S. Cl. ..... 227/146; 227/81; 227/129; 227/132; 227/133

(58) Field of Classification Search ..... 227/120, 227/81, 129, 132, 139, 146, 12, 9, 133
See application file for complete search history.

(56) References Cited

U.S. PATENT DOCUMENTS 2,819,466 A * 1/1958 Campbell et al. ..... 227/127
3,004,260 A * 10/1961 Van Den Elzen ..... 227/134
3,589,588 A * 6/1971 Vasku ..... 227/132
(Continued)

FOREIGN PATENT DOCUMENTS

CN 1042605 3/1999
CN 1895854 1/2007
(Continued)

OTHER PUBLICATIONS

Taiwan Office Action; Application No. 97110768 dated Jun. 14, 2012.

*Primary Examiner* — Brian D Nash
(74) *Attorney, Agent, or Firm* — Antonelli, Terry, Stout & Kraus, LLP.

(57) ABSTRACT

A fastener driving tool includes a housing, a motor, a plunger, a spring, a drum, and one of a cable and a sheet member. The motor is provided in the housing. The plunger is provided in the housing for impacting a fastener in a fastener driving direction. The spring urges the plunger in the fastener driving direction. The drum is rotatably supported in the housing and is rotationally driven by the motor. The one of a cable and a sheet member is capable of being wound over the drum and has one end fixed to the drum and another end acting on the spring for transmitting a driving force of the motor to the spring. The spring is configured to accumulate a resilient energy therein for impacting the fastener by the plunger. The resilient energy of the spring is accumulated by forcible resilient deformation thereof as a result of winding of the one of the cable and the sheet member over the drum rotationally driven by the motor.

16 Claims, 13 Drawing Sheets

U.S. PATENT DOCUMENTS

| | | | | | |
|---|---|---|---|---|---|
| 3,924,789 | A | * | 12/1975 | Avery et al. | 227/131 |
| 4,042,036 | A | * | 8/1977 | Smith et al. | 173/13 |
| 4,189,080 | A | * | 2/1980 | Smith et al. | 227/8 |
| 4,215,808 | A | * | 8/1980 | Sollberger et al. | 227/146 |
| 4,323,127 | A | * | 4/1982 | Cunningham | 173/53 |
| 4,544,090 | A | * | 10/1985 | Warman et al. | 227/131 |
| 4,721,170 | A | * | 1/1988 | Rees | 173/13 |
| 4,865,229 | A | * | 9/1989 | Schneider et al. | 222/325 |
| 4,928,868 | A | | 5/1990 | Kerrigan | |
| 5,069,379 | A | * | 12/1991 | Kerrigan | 227/131 |
| 5,098,004 | A | * | 3/1992 | Kerrigan | 227/134 |
| 5,320,270 | A | | 6/1994 | Crutcher | |
| 5,511,715 | A | * | 4/1996 | Crutcher et al. | 227/131 |
| 5,720,423 | A | * | 2/1998 | Kondo et al. | 227/130 |
| 6,604,666 | B1 | * | 8/2003 | Pedicini et al. | 227/131 |
| 6,899,260 | B2 | * | 5/2005 | Sun | 227/132 |
| 6,971,567 | B1 | | 12/2005 | Cannaliato et al. | |
| 6,997,367 | B2 | * | 2/2006 | Hu | 227/132 |
| 7,152,774 | B2 | * | 12/2006 | Chen | 227/131 |
| 7,543,728 | B2 | * | 6/2009 | Spasov et al. | 227/132 |
| 7,578,420 | B2 | * | 8/2009 | Tanimoto et al. | 227/132 |
| 7,637,408 | B2 | * | 12/2009 | Takahashi et al. | 227/133 |
| 2006/0027622 | A1 | * | 2/2006 | Sun | 227/131 |
| 2006/0175374 | A1 | * | 8/2006 | Zahner et al. | 227/10 |
| 2006/0261127 | A1 | * | 11/2006 | Wolf et al. | 227/131 |
| 2007/0023472 | A1 | | 2/2007 | Schiestl | |
| 2008/0257934 | A1 | * | 10/2008 | Tanimoto et al. | 227/146 |

FOREIGN PATENT DOCUMENTS

| | | | |
|---|---|---|---|
| DE | 196 29 762 | A1 | 1/1997 |
| DE | 10 2005 000 089 | A1 | 1/2007 |
| JP | 60-16372 | | 1/1985 |
| JP | 8-205573 | | 8/1996 |
| JP | 9-94769 | | 4/1997 |
| JP | 09-295283 | | 11/1997 |
| JP | 2007-21715 | | 2/2007 |
| TW | 200605993 | | 2/2006 |
| WO | WO 2007/142996 | A2 | 12/2007 |

* cited by examiner

FASTENER DRIVING TOOL

TECHNICAL FIELD

The present invention relates to a fastener driving tool, and more particularly, to an electrical fastener driving tool.

BACKGROUND ART

In a conventional fastener driving tool, a fastener such as a nail is adapted to be driven into a workpiece such as a wood and a gypsum plaster board by urging and accelerating a plunger using an urging force of a spring. Such fastener driving tool accumulates an resilient energy of the spring by a motor accommodated in the fastener driving tool.

A coil spring can accumulate an resilient energy by expansion or compression. The expansion or compression of the coil spring is achieved by a motor, a reduction gear, a plunger and a plurality of rotation gears as described in Japanese Patent Publication No. H09-295283. Each of the plurality of the rotation gears has a driving pin that is fixed at a position separately from a rotation center of each rotation gear. The plunger has a plurality of protrusions. The plunger is pushed up in a prescribed stroke by engagement between the driving pins and the plurality of protrusions. With this structure, one rotation gear can push up the plunger in expansion or compression stroke of the spring that is equal to a diameter of the rotation gear. Thus, if the prescribed stroke of the plunger is increased, expansion or compression stroke of the spring must be increased. Thus, the diameter of the rotation gear or the number of the rotation gears must be increased.

DISCLOSURE OF THE INVENTION

However, if the diameter of the rotation gear or the number of the rotation gears is increased, the fastener driving tool may become bulky in a direction other than a stroke direction of the plunger.

In view of the foregoing, it is an object of the present invention to provide a fastener driving tool having a compact and lightweight structure.

In order to attain the above and other objects, the present invention provides a fastener driving tool including a housing, a motor, a plunger, a spring, a drum, and one of a cable and a sheet member. The motor is provided in the housing. The plunger is provided in the housing for impacting a fastener in a fastener driving direction. The spring urges the plunger in the fastener driving direction. The drum is rotatably supported in the housing and is rotationally driven by the motor. The one of a cable and a sheet member is capable of being wound over the drum and has one end fixed to the drum and another end acting on the spring for transmitting a driving force of the motor to the spring. The spring is configured to accumulate a resilient energy therein for impacting the fastener by the plunger. The resilient energy of the spring is accumulated by forcible resilient deformation thereof as a result of winding of the one of the cable and the sheet member over the drum rotationally driven by the motor.

Preferably, the one of the cable and the sheet member is connected to the plunger. The resilient energy of the spring is accumulated therein as a result of pulling the plunger by the one of the cable and the sheet member.

With this arrangement, resilient energy can be accumulated in the spring via one of the wire and the sheet member. Accordingly, there is no need to provide a gear for compressing the spring, thereby providing a compact and lightweight fastener driving tool.

Preferably, the one of the cable and the sheet member has a bundle of fibers. The fibers are made from metal. The one of the cable and the sheet member has a surface coated with a resin.

With these arrangements, the wire and the sheet member can have a high strength and flexibility, and does not damage to another parts such as a drum.

Preferably, the fastener driving tool further includes a clutch provided between the motor and the drum. The clutch is movable between a transmission position where the driving force of the motor is transmitted to the drum and a shut-off position where transmission of the driving force of the motor to the drum is shut-off.

With this arrangement, a connection between the drum and the motor can be shut-off by controlling the clutch. Thus, if the connection between the drum and the motor is shut-off in a state that the resilient energy is accumulated in the spring, the drum can become freely rotatable, thereby releasing the resilient energy of the spring. Accordingly, one of the wire and the sheet member wound over the drum is released from the drum, thereby impacting the fastener by the plunger.

Preferably, the clutch includes a power transmission pin movable between the transmission position and the shut-off position. The drum and the motor are connected to integrally rotate with each other via the power transmission pin at the transmission position of the power transmission pin.

Preferably, the clutch further includes a pin guide for guiding movement of the power transmission pin between the transmission position and the shut-off position. The pin guide is configured to guide the movement of the power transmission pin between the transmission position and the shut-off position in accordance with a rotational position of the drum.

With these arrangements, a clutch mechanism for transmitting/shutting off between the drum and the motor can be obtained easily.

Preferably, the clutch further includes a first member and a second member supporting the first member. The first member contacts the power transmission pin at the transmission position and separating from the power transmission pin at the shut-off position. The first member and the second member are made from materials different from each other.

With this arrangement, at least the first member can be made from a high strength material and the second member can be made from a lightweight material, thereby resulting in a high resistant and lightweight fastener driving tool.

Preferably, the first member and the second member are connected to the plunger. The second member has a density lower than that of the first member. With this arrangement, the first member and the second member move together during a fastener driving operation by the plunger. Since the lightweight second member is used, high acceleration of the plunger results to enhance a response of the fastener driving operation.

Preferably, the fastener driving tool further includes a power transmission mechanism positioned between the motor and the drum for transmitting a driving force of the motor to the drum. The power transmission mechanism includes a planetary gear mechanism.

With this arrangement, a torque generated in the motor can be increased and a rotating speed of a shaft for driving the drum can be made smaller than that of the motor.

Preferably, the spring has a displacement for accumulating the resilient energy therein. The displacement is less than a circumference length of the drum.

With this arrangement, one of the wire and the sheet member can be wound over the drum in less than a single turn. Accordingly, an entanglement of one of the wire and the sheet member can be prevented, thereby winding and releasing one of the wire and the sheet member over or from the drum properly.

Preferably, the drum includes a latching portion and the housing includes a latched portion. The latching portion and the latched portion are configured to latch with each other in a state that the drum is positioned at an angular initial rotational position where the drum is about to wind the one of the cable and sheet member.

With this arrangement, excessive rotation of the drum in the housing can be prevented. Further, since the initial position for winding one of the wire and the sheet member is defined, a time period from a start timing to an end timing of the fastener driving operation can be stabilized.

Further, in order to attain the above and other objects, the present invention provides a fastener driving tool including a housing, a motor, a plunger, a spring, a drum, one of a cable and a sheet member, and a clutch. The motor is provided in the housing. The plunger is provided in the housing for impacting a fastener in a fastener driving direction. The spring urges the plunger in the fastener driving direction. The drum is rotatably supported in the housing and is rotationally driven by the motor. The one of a cable and a sheet member is capable of being wound over the drum and has one end fixed to the drum and another end connected to the spring. The spring is configured to accumulate a resilient energy as a result of winding of the one of the cable and the sheet member over the drum. The clutch selectively transmits a driving force of the motor to the drum.

Furthermore, in order to attain the above and other objects, the present invention provides a fastener driving tool including a housing, a motor, a plunger, a spring, a mechanism portion, a clutch, and a power transmission pin. The motor is provided in the housing. The plunger is provided in the housing for impacting a fastener in a fastener driving direction. The spring urges the plunger in the fastener driving direction. The mechanism portion is provided in the housing for accumulating an energy required for impacting the fastener by the motor. The clutch is provided between the motor and the mechanism portion and is movable between a transmission position where the driving force of the motor is transmitted to the mechanism portion and a shut-off position where transmission of the driving force of the motor to the mechanism portion is shut-off. The power transmission pin is provided in the clutch and is movable between the transmission position and the shut-off position. The mechanism portion and the motor are connected to integrally rotate with each other via the power transmission pin at the transmission position of the power transmission pin. The clutch includes a first member and a second member supporting the first member. The first member contacts the power transmission pin at the transmission position and separates from the power transmission pin at the shut-off position. The first member and the second member are made from materials different from each other.

Preferably, the first member and the second member are connected to the plunger. The second member has a density lower than that of the first member.

BRIEF DESCRIPTION OF REFERENCE NUMERALS

1: nail gun

1A: nail

Figure 1:
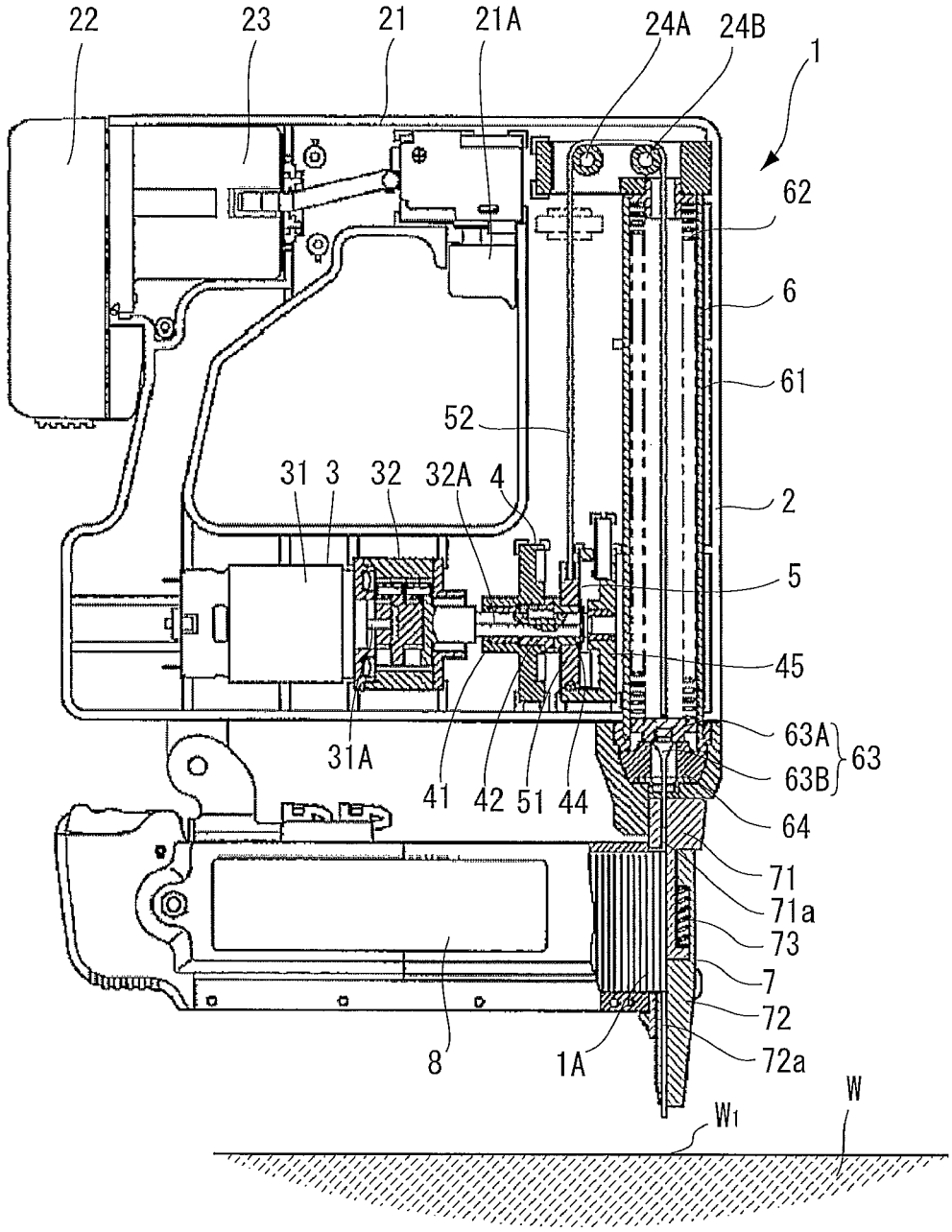
FIG. 1 is a cross-sectional view of a fastener driving tool according to a first embodiment of the present invention.

2: housing
3: driving portion
4: clutch mechanism
5: transmission portion
6: coil spring portion
7: nose portion
8: magazine
21: handle
21A: trigger
22: battery
24A: guide pulley
31: motor
31A: driving shaft
32: planetary gear mechanism
32A: output shaft
41: guide plate
41*a*: through-hole
41*b*: pin guide groove
42: pin supporting portion
42*a*: through-hole
42B: projecting portion
42*b*: slit
43: power transmission pin
43A: pin groove sliding portion
43B: pin hook portion
43C: pin sliding portion
44: drum hook
44A: bearing
44B: hook portion
45: shaft supporting portion
45B: latched portion
51: drum
51A: latching portion
51*a*: through-hole
51*b*: wire guide groove
52: cable
61: spring guide
62: coil spring
63: plunger
63A: urging portion
63B: blade
63*a*: air pass
64: damper
71: base
71*a*: through-hole
72: nose
72*a*: injection hole
73: nose urging spring
104: clutch mechanism
141: guide plate
141A: rail portion
141B: slant surface
141C: plane end surface
142: pin supporting portion
142A: pin urging spring
143: power transmission pin
144: drum hook
201: nail gun
201A: nail
202: housing
203: driving portion
204: clutch mechanism
205: transmission portion
206: coil spring portion
207: nose portion
208: magazine
221: handle
221A: trigger
221B: switch
222: battery
231: motor
231A: driving shaft
232: planetary gear mechanism
232A: output shaft
232B: gear
234A: pulley
234B: belt
251: drum
252: cable
252A: retained portion
252B: cable portion
261: spring guide
262: coil spring
263: plunger
263A: urging main body
263B: blade
263C: retaining portion
263D: engaged portion
263E: engaging portion
263G: buffer
263*a*: through-hole
264: bumper
361: spring guide
361*a*: though-hole
363: plunger
363*b*: groove
404: clutch mechanism
444: drum hook
444B: hook portion
444C: first portion
444D: second portion
463: plunger
463A: urging main body
463B: blade
463*b*: through-hole
463*c*: through-hole
463F: pin

DETAILED DESCRIPTION OF THE PREFERRED EMBODIMENTS

A fastener driving tool according to a first embodiment of the present invention will be described with reference to FIGS. 1 through 5C. The fastener driving tool shown in FIG. 1 is an electrically-operated type nail gun 1 where a fastener such as a nail 1A is adapted to be driven into a workpiece W such as a wood and a gypsum plaster board. The nail gun 1 mainly includes a housing 2, a driving portion 3, a clutch mechanism 4, a transmission portion 5, a coil spring portion 6, a nose portion 7, and a magazine 8. Hereinafter, a direction in which a plunger 63 described later moves away from a damper 64 described later will be described as an upper direction, and a direction in which the plunger 63 is urged by a coil spring 62 described later to strike the nail 1A will be described as a lower direction.

The housing 2 is made from resin such as nylon and polycarbonate and accommodates the driving portion 3 and the like. A handle 21 is provided on an upper section of the housing 2 and is provided with a trigger 21A to control the driving portion 3. A battery 22 is detachably provided on the handle 21. The handle 21 is also provided with a power supply portion (not shown) to supply electric power supplied from the battery 22 to the driving portion 3.

The driving portion 3 mainly includes a motor 31 and a planetary gear mechanism 32. The motor 31 is provided on a lower section of the housing 2 and is located below the handle 21. The motor 31 has a driving shaft 31A directing perpendicular to the upper and lower direction. The planetary gear mechanism 32 is provided on an end of the driving shaft 31A and is a well-known gear mechanism including a sun gear, an orbital gear, and an output shaft 32A. The output shaft 32A of the planetary gear mechanism is fixed coaxially with the driving shaft 31A. The planetary gear mechanism 32 can have a compact size, and increased reduction ratio of the planetary gear mechanism 32 can be provided. Thus, a compact nail gun 1 can result, even if the reduction ratio of the planetary gear mechanism 32 is increased.

Figure 2:
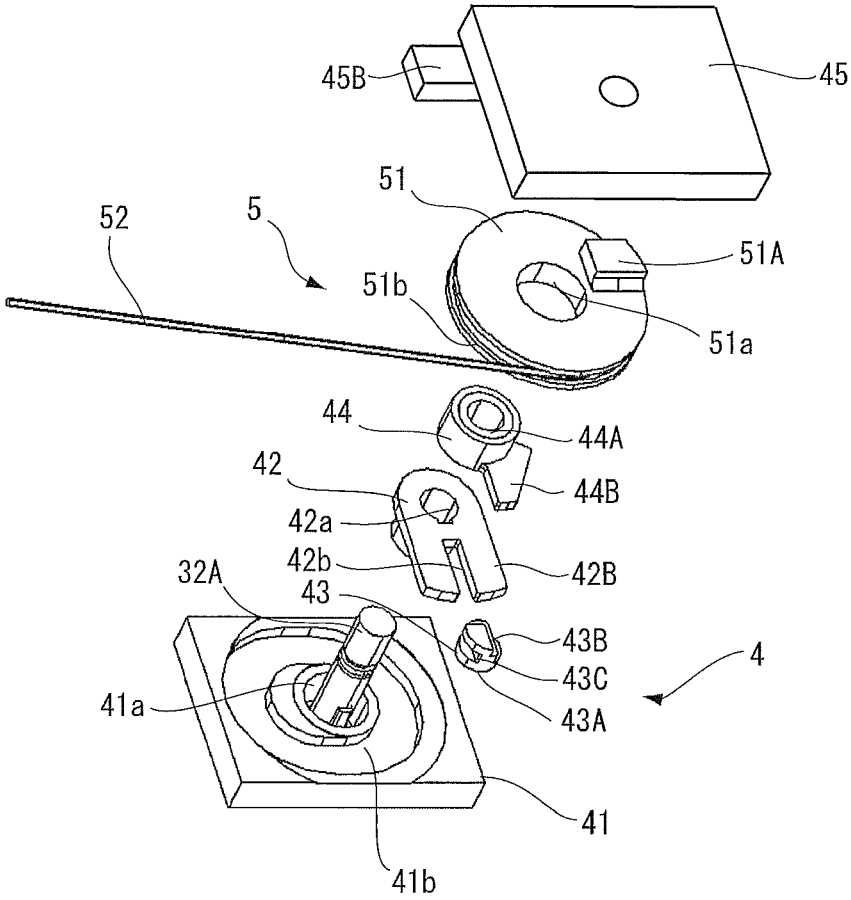
FIG. 2 is an exploded perspective view of a clutch mechanism of the fastener driving tool according to the first embodiment of the present invention.

As shown in FIGS. 1 and 2, the clutch mechanism 4 mainly includes a guide plate 41, a pin supporting portion 42, a power transmission pin 43, and a drum hook 44. The clutch mechanism 4 is disposed near the driving portion 3 and is connected to the output shaft 32A.

As shown in FIG. 1, the guide plate 41 is accommodated in and fixed to the housing 2. As shown in FIG. 2, the guide plate 41 is formed with a through-hole 41*a*, through which the output shaft 32A penetrates, at a center of the guide plate 41. The guide plate 41 has a surrounding portion that surrounds the through-hole 41*a*. The surrounding portion is formed with a looped pin guide groove 41*b* having an oblong shape. A distance from a centeral axis of the output shaft 32A to an outer edge of the pin guide groove 41*b* is not constant in a circumferential direction of the outer edge. Specifically, the central axis of the output shaft 32A is located at one imaginary focal position of the pin guide groove 41*b* (oblong shape has two focal positions).

The pin supporting portion 42 is disposed at a position opposite to the driving portion 3 with respect to the guide plate 41. The pin supporting portion 42 is formed with a through-hole 42*a*. The pin supporting portion 42 is rotatable together with the output shaft 32A by fixedly inserting the output shaft 32A into the through-hole 42*a*. The pin supporting portion 42 has a projecting portion 42B extending in a direction substantially perpendicular to a penetration direction of the through-hole 42*a*. The projecting portion 42B is formed with a slit 42*b* extending in a direction substantially perpendicular to the penetration direction of the through-hole 42*a*.

The power transmission pin 43 has a pin groove sliding portion 43A located at one end thereof, a pin hook portion 43B located at another end thereof, and a pin sliding portion 43C interposed between the pin groove sliding portion 43A and the pin hook portion 43B. The pin sliding portion 43C is inserted into the slit 42*b* and slidable with respect to the pin supporting portion 42. The pin groove sliding portion 43A is inserted into the pin guide groove 41*b* while the power transmission pin 43 being inserted into the slit 42*b*. The power transmission pin 43 slidably and circularly moves in the pin guide groove 41*b*.

The pin guide groove 41*b* has the oblong shape around the central axis of the output shaft 32A. The pin supporting portion 42 is fixed to the output shaft 32A, and is rotatable about the central axis of the output shaft 32A. Therefore, the power transmission pin 43 inserted into the pin guide groove 41*b* moves toward and away from the central axis of the output shaft 32A in the slit 42*b* in accordance with a change in angular rotational position of the pin supporting portion 42. The pin hook portion 43B has a plane substantially perpendicular to a circularly moving direction of the power transmission pin 43.

The drum hook 44 is made from a metal and includes a bearing 44A formed with a through-hole. The output shaft 32A is inserted into the through-hole of the bearing 44A. The drum hook 44 is disposed at a position opposite to the guide plate 41 with respect to the pin supporting portion 42. The drum hook 44 is rotatable about the central axis of the output shaft 32A, but is not fixed to the output shaft 32A. The drum hook 44 includes a hook portion 44B extending in a direction perpendicular to the central axis of the output shaft 32A. The hook portion 44B is capable of contacting with the pin hook portion 43B while the drum hook 44 being assembled to the output shaft 32A.

A shaft supporting portion 45 is provided on a position opposite to the driving portion 3 with respect to the clutch mechanism 4. The shaft supporting portion 45 is fixed to the housing 2 and rotatably supports a distal end of the output shaft 32A. The shaft supporting portion 45 has one side facing the clutch mechanism 4, and includes a latched portion 45B on the one side. The latched portion 45B is capable of latching onto a latching portion 51A described later.

As shown in FIG. 1, the transmission portion 5 mainly includes a drum 51 and a cable 52. As shown in FIG. 2, the drum 51 has a ring shape forming a through-hole 51*a*. One end of the drum hook 44 opposite to the driving portion 3 is force-fitted with the through-hole 51*a*. The drum 51 is located adjacent to the clutch mechanism 4. Since the drum 51 is connected to the drum hook 44 by force-fitting with the through-hole 51*a*, the drum 51 is coaxially rotatable together with the drum hook 44. The drum 51 is formed with a cable guide groove 51*b* at an entire circumference thereof.

The drum 51 includes the latching portion 51A protruding from one side surface thereof, the one side surface being positioned opposite to the clutch mechanism 4. The latching portion 51A and the latched portion 45B is configured to latch with each other in a state that the drum 51 is positioned at an angular rotational position where the drum 51 begins to wind the cable 52. Accordingly, the latching portion 51A and the latched portion 45B can define an initial position that the drum 51 begins to rotate.

A length of the circumference of the drum 51 is substantially four-thirds of a length that the coil spring moves from a bottom dead center to a top dead center described later.

One end of the cable 52 is fixed to the cable guide groove 51*b* of the drum 51, and another end of the cable 52 is connected to an urging portion 63A described later. The cable 52 has fibrous steel wires bundled together as a wire bundle. A surface of the wire bundle is coated with a resin. Thus, the cable 52 has a high strength and flexibility. Since the surface of the wire bundle is coated with resin, the cable 52 does not damage to the drum 51 and the like such as scratching. Two guide pulleys 24A and 24B are provided in the housing 2 in order to suspend the cable 52.

The coil spring portion 6 mainly includes a spring guide 61, the coil spring 62, and the plunger 63. The spring guide 61 is provided in the housing 2 as a separate member. The spring guide 61 has cylindrical two-layer structure. An outer layer of the spring guide 61 is made from aluminum or resin such as nylon and polycarbonate and defines an outer peripheral surface of the spring guide 61. An inner layer of the spring guide 61 is made from steel having a hardness the same as that of the coil spring 62 and defines an inner peripheral surface of the spring guide 61. An axis of the spring guide 61 is parallel to the upper and lower direction. Accordingly, the spring guide 61 has an abrasion resistance against the coil spring 62 and can have a lightweight structure. The inner peripheral surface of the inner layer is coated with an ultrahigh molecular weight polyethylene layer that has a low coefficient of friction.

The coil spring 62 is inserted into the spring guide 61. The coil spring 62 is made from steel and has an outer diameter that is slightly smaller than an inner diameter of the spring guide 61. As described above, the inner layer of the spring guide 61 is made from steel having the hardness the same as that of the coil spring 62. Thus, frictional wearing of the inner layer can be lower than that of an inner layer made from resin when the coil spring 62 and the urging portion 63A described later are slidingly moved with respect to the spring guide 61. Further, since the inner peripheral surface of the inner layer of the spring guide 61 is coated with the ultrahigh molecular weight polyethylene layer, the abrasion resistance of the spring guide 61 against the coil spring 62 can be further improved. Furthermore, since the spring guide 61 is a separate member with respect to the housing 2, only the spring guide 61 can be replaced by a new spring guide if the spring guide 61 is damaged or excessively worn.

Figure 3:
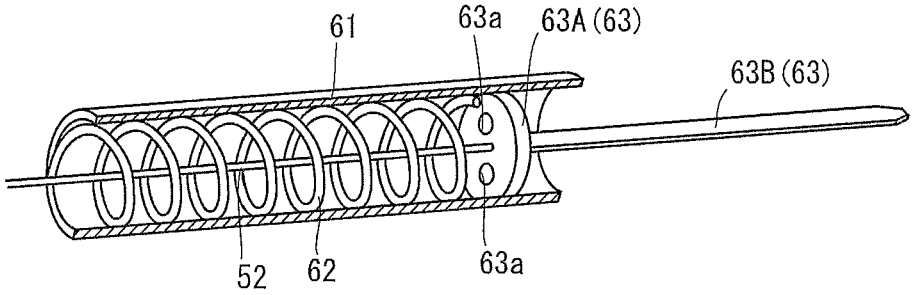
FIG. 3 is a perspective partially cut away showing a spring guide and its associated components according to the first embodiment of the present invention.

As shown in FIG. 3, the plunger 63 has the urging portion 63A and a blade 63B. The urging portion 63A is located on a lower end of the coil spring 62. The urging portion 63A is made from a metal and has a disk shape having an outer diameter substantially the same as that of the coil spring 62. The urging portion 63A is connected at a center position thereof to the other end of the cable 52 which is inserted into the coil spring 62. Thus, the urging portion 63A can be pulled by the cable 52, and is movable upwardly against an urging force of the coil spring 62 along the spring guide 61, and can compress the coil spring 62. Since the outer diameter of the urging portion 63A is substantially the same as that of the coil spring 62, the urging portion 63A can have an optimized size, thereby resulting a compact nail gun 1. A position, where the urging portion 63A is positioned at its lowest position while being urged by the coil spring 62 in an initial state prior to nail driving operation, will be referred to as the bottom dead center. Another position, where the urging portion 63A is positioned at its highest position while being pulled by the cable 52, will be referred to as the top dead center. The urging portion 63A is formed with a pair of air passes 63*a* extending through a thickness of the urging portion 63A.

The blade 63B is an elongated plate and protrudes from a central portion of the urging portion 63A in a direction opposite to the cable 52. As shown in FIG. 1, the damper 64 is provided below the urging portion 63A in the housing 2. The damper 64 is made from a resin such as a flexible rubber, a urethane and the like.

Figure 5A:
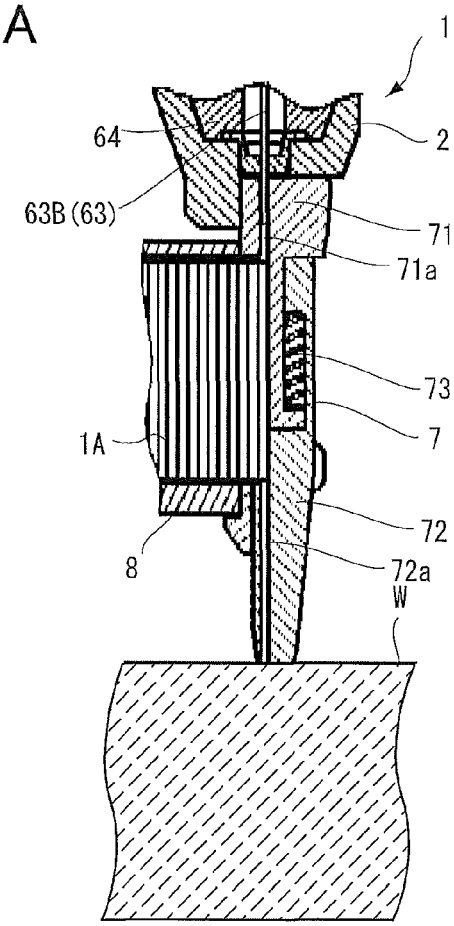
FIG. 5A is a cross-sectional view showing a periphery of a nose portion in a state before the nail driving operation.

As shown in FIG. 1, the nose portion 7 is located below the coil spring portion 6. As shown in FIGS. 1 and 5A, the nose portion 7 mainly includes a base 71, a nose 72, and a nose urging spring 73. The base 71 is fixed to the housing 2 by a screw and is formed with a through-hole 71*a* that allows the blade 63B to extend thereinto. The nose 72 is located below the base 71 and capable of moving in upper and lower direction with respect to the base 71. The nose 72 is formed with an injection hole 72*a* into which the blade 63B can extend. The nose urging spring 73 is interposed between the base 71 and the nose 72, and urges the nose 72 upwardly, i.e. in a direction opposite to a nail driving direction with respect to the base 71. Accordingly, the nose 72 can normally maintain contact with the base 71 by the urging force of the nose urging spring 73.

As shown in FIG. 1, in the initial state prior to nail driving operation, the blade 63B penetrates both of the through-hole 71*a* of the base 71 and the injection hole 72*a* of the nose 72, and a distal end of the blade 63B is projected from a lowest edge of the nose 72 while the nose 72 contacts the base 71.

The magazine 8 is detachably provided on the nose portion 7 and accommodates a plurality of nails 1A. Each of the plurality of nails 1A is supplied to be spanned between the base 71 and the nose 72 to be driven by the blade 63B.

In the above-described nail gun 1, when the nail 1A is to be driven into the workpiece W, firstly, a target position, into which the nail 1A is driven, of the workpiece W is decided by contacting the distal end of the blade 63B projecting from the lowest edge of the nose 72 to a driven area W1 of a surface of the workpiece W. Since the blade 63B is positioned on a trajectory through which a driven nail 1A passes and the target nail driving position can be determined by the blade 63B projecting from the lowest edge of the nose 72, the nail driven position can be defined easily and accurately.

In a state that the driving position is decided, user pulls the trigger 21A to supply power to the motor 31 and to rotate the driving shaft 31A. Rotation of the driving shaft 31A is transmitted to the output shaft 32A by way of the planetary gear mechanism 32 that decelerates rotating speed of the driving shaft 31A.

Figure 4A:
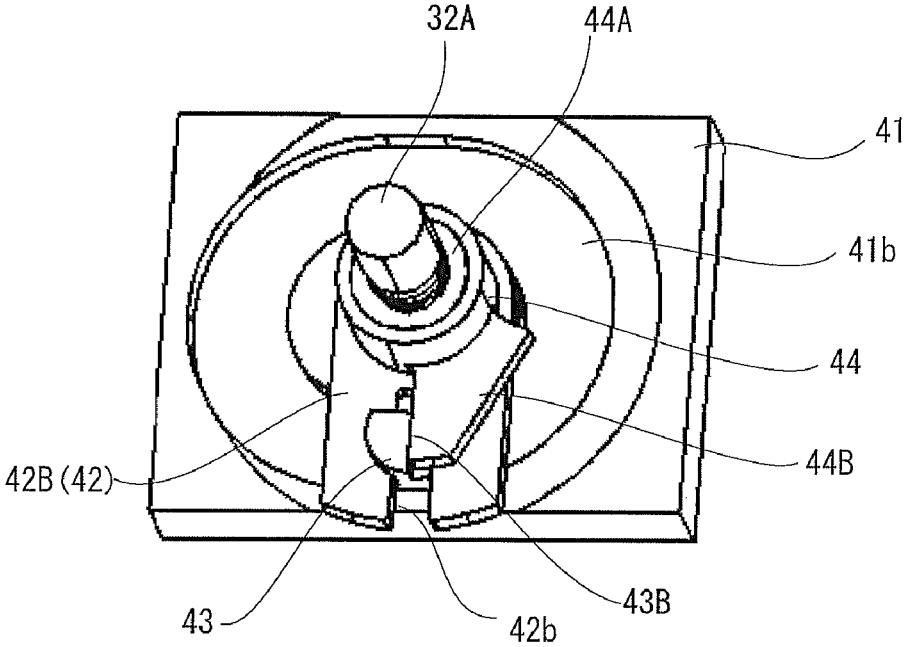
FIG. 4A is a perspective view showing the clutch mechanism in a state that a drum is located in its initial position.

As shown in FIG. 4A, the pin supporting portion 42 coaxially fixed to the output shaft 32A rotates by the rotation of the output shaft 32A and the power transmission pin 43 supported on the pin supporting portion 42 will be brought into abutment with the hook portion 44B of the drum hook 44. A position where the power transmission pin 43 abuts against the drum hook 44 is defined as a transmitting position. The drum 51 has an initial position where the latching portion 51A can latch with the latched portion 45B while the drum hook 44 is located in a position shown in FIG. 4A.

Figure 4B:
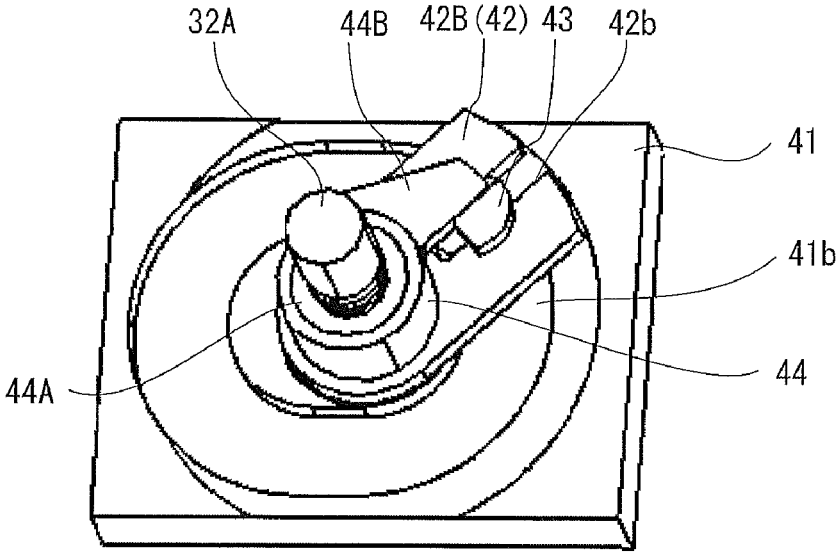
FIG. 4B is a perspective view showing the clutch mechanism in a state that the drum rotates together with an output shaft.

As shown in FIG. 4B, the output shaft 32A and the pin supporting portion 42 rotate in a counterclockwise direction while the power transmission pin 43 is positioned at its the transmission position. Thus, the drum hook 44 in abutment with the power transmission pin 43 also rotates. Since the drum 51 is fixed to drum hook 44, the drum 51 rotates and wound up the cable 52 over the cable guide groove 51*b*.

The urging portion 63A connected to the other end of the cable 52 is pulled upwardly by the cable 52 winding upwardly against the urging force of the coil spring 62, and compresses the coil spring 62. A locus of the connection position between the urging portion 63A and the cable 52 passes through an inner region of the coil spring 62, the inner region being defined by an inner surface of the coil spring 62, and approximately in conformance with a central axis of the coil spring 62 while compressing the coil spring 62. Thus, the urging portion 63A can be pulled in a direction parallel to the central axis of the coil spring 62. Therefore, the urging portion 63A moves in a state that a surface, to which the coil spring 62 contacts, of the urging portion 63A is perpendicular to the central axis of the coil spring 62.

The outer diameter of the urging portion 63A is substantially the same as that of the coil spring 62. Accordingly, excessive contact of the urging portion 63A and the coil spring 62 with the spring guide 61 can be eliminated, and a load imparted on the motor 31 can be only a load of the compression of the coil spring 62, thereby providing a low electricity consumption at the motor 31.

Figure 4C:
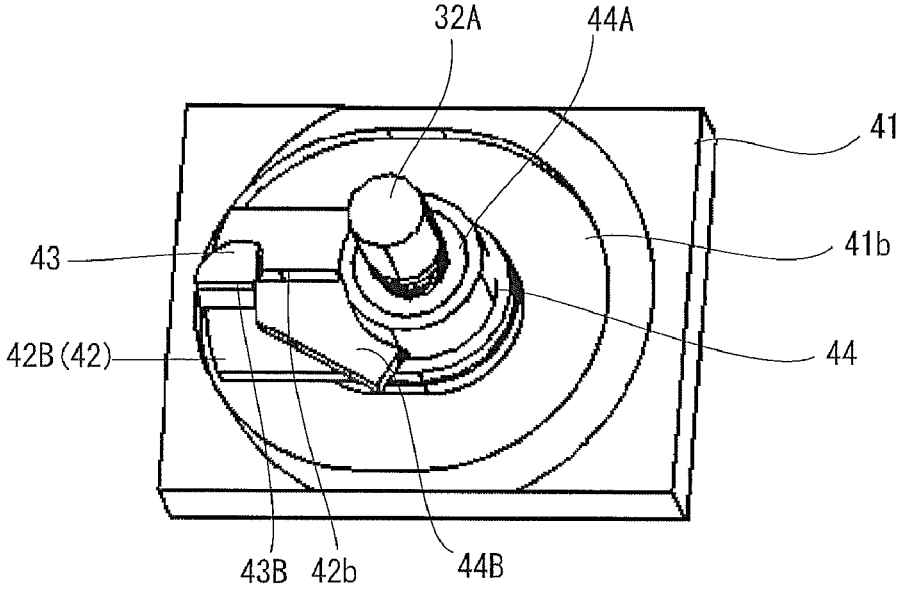
FIG. 4C is a perspective view showing the clutch mechanism in a state that a power transmission pin is located on a shut-off position.

In a state shown in FIG. 4C the output shaft 32A has rotated substantially 270 degrees from the state shown in FIG. 4A. In this state, the power transmission pin 43 moves away from the output shaft 32A along the slit 42*b* due to the oblong shape of the pin guide groove 41*b*, thereby releasing from the drum hook 44. Accordingly, a transmission of driving force from the output shaft 32A to the drum 51 rotatable together with the drum hook 44 is shut-off. A position where the power transmission pin 43 does not abut against the drum hook 44 is defined as a shut-off position. The plunger 63 is pulled substantially to the top dead center when the output shaft 32A rotates substantially 270 degrees from the state shown in FIG. 4A. Therefore, the coil spring 62 is compressed and has maximum resilient energy at the shut-off position.

Figure 4D:
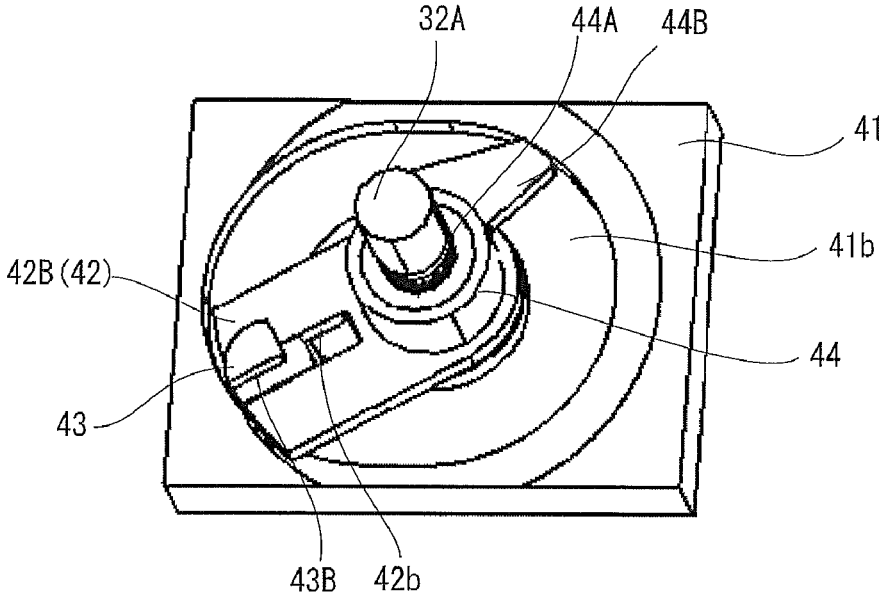
FIG. 4D is a perspective view showing the clutch mechanism in a state that a plunger is performing a nail driving operation.

Upon shutting off the transmission of the driving force to the drum 51, a pulling of the urging portion 63A by the cable 52 is stopped. Thus, the urging portion 63A rapidly moves toward the bottom dead center by the resilient energy of the coil spring 62, thereby impacting the nail 1A by the blade 63B. As shown in FIG. 4D, since the cable 52 is released from the drum 51, the drum 51 and the drum hook rotates in the clockwise direction opposite to a rotational direction of the output shaft 32A.

The spring guide 61 has a cylindrical shape and accommodates the urging portion 63A therein. Thus, a space, in which the coil spring 62 is accommodated, in the spring guide 61 is substantially hermetically-sealed space. The urging portion 63A divides the space in the spring guide 61 into a first space positioned above the urging portion 63A and a second space positioned below the urging portion 63A. When the urging portion 63A moves from the top dead center toward the bottom dead center, the urging portion 63A compresses an air in the second space of the spring guide 61. In this case, the urging portion 63A is subject to so-called an air damper effect, and the rapidly movement of the urging portion 63A may be prevented. However, the pair of air passes 63*a* is formed in the urging portion 63A, and the first space and the second space are in fluid communication with each other via the pair of air passed 63*a*. Therefore, the air damper effect can be prevented, and the urging portion 63A can be moved from the top dead center toward the bottom dead center rapidly.

Further, since the inner peripheral surface of the inner layer of the spring guide 61 is coated with the ultrahigh molecular weight polyethylene layer, a contact resistance between the spring guide 61 and the coil spring 62, which is being moved toward the bottom dead center, can be reduced. Accordingly, a waste of the resilient energy accumulated in the coil spring 62 can be prevented, thereby increasing the impact force for the nail 1A.

Figure 5B:
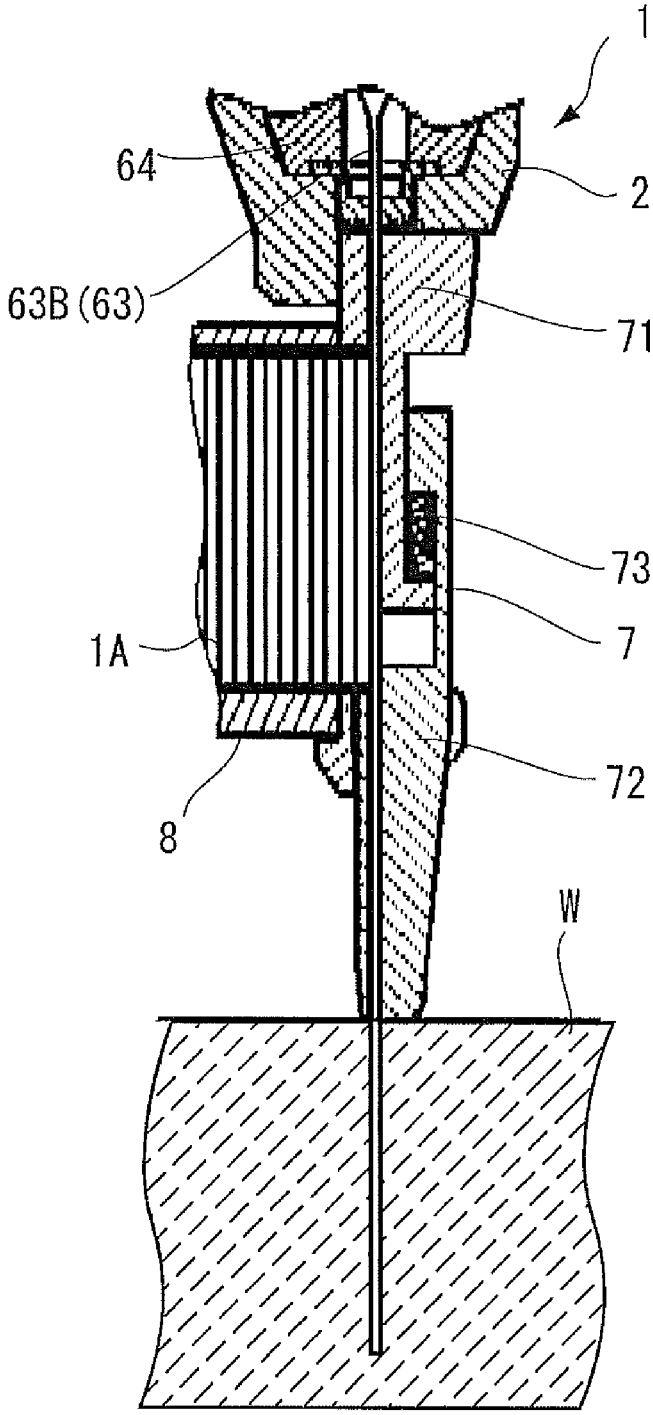
FIG. 5B is a cross-sectional view showing a periphery of a nose portion in a state during the nail driving operation.

Upon moving the plunger 63 downward rapidly, the nail gun 1 other than the plunger 63 is subject to a reaction force as a counteraction. Unless the user presses the nail gun 1 toward the workpiece W strongly, the nose portion 7 may be moved away from the workpiece W, thereby moving away the nail gun 1 from the workpiece W. However, as shown in FIG. 5B, since the nose urging spring 73 is interposed between the base 71 and the nose 72, at least the nose 72 still stays on or close to the surface of the workpiece W by inertial force, thereby guiding the nail 1A. Accordingly, the nail 1A can be adequately held and guided in the nose portion 7 during the nail driving operation without strongly pressing the nail gun 1 toward the workpiece W.

Figure 4E:
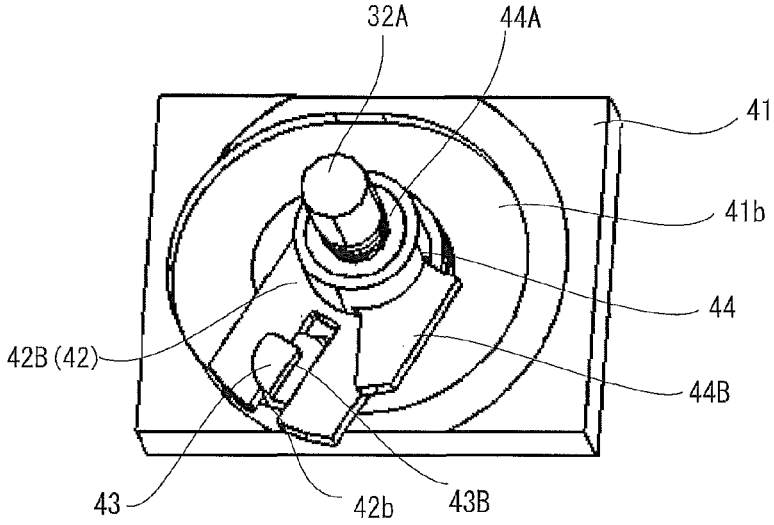
FIG. 4E is a perspective view showing the clutch mechanism in a state after the nail driving operation.

As shown in FIG. 4E, the drum hook 44 rotates in the clockwise direction so that the drum 51 reaches the initial position, after the coil spring 62 has been moved to the bottom dead center and the nail 1A has been driven into the workpiece W by the plunger 63. On the other hand, the pin supporting portion 42 rotates in the counterclockwise direction, thereby moving the power transmission pin 43 from the shut-off position to the transmitting position along the pin guide groove 41*b*. Accordingly, the power transmission pin 43 latches with the hook portion 44B again and the power transmission pin 43 and the hook portion 44B return to the state shown in FIG. 4A.

Figure 5C:
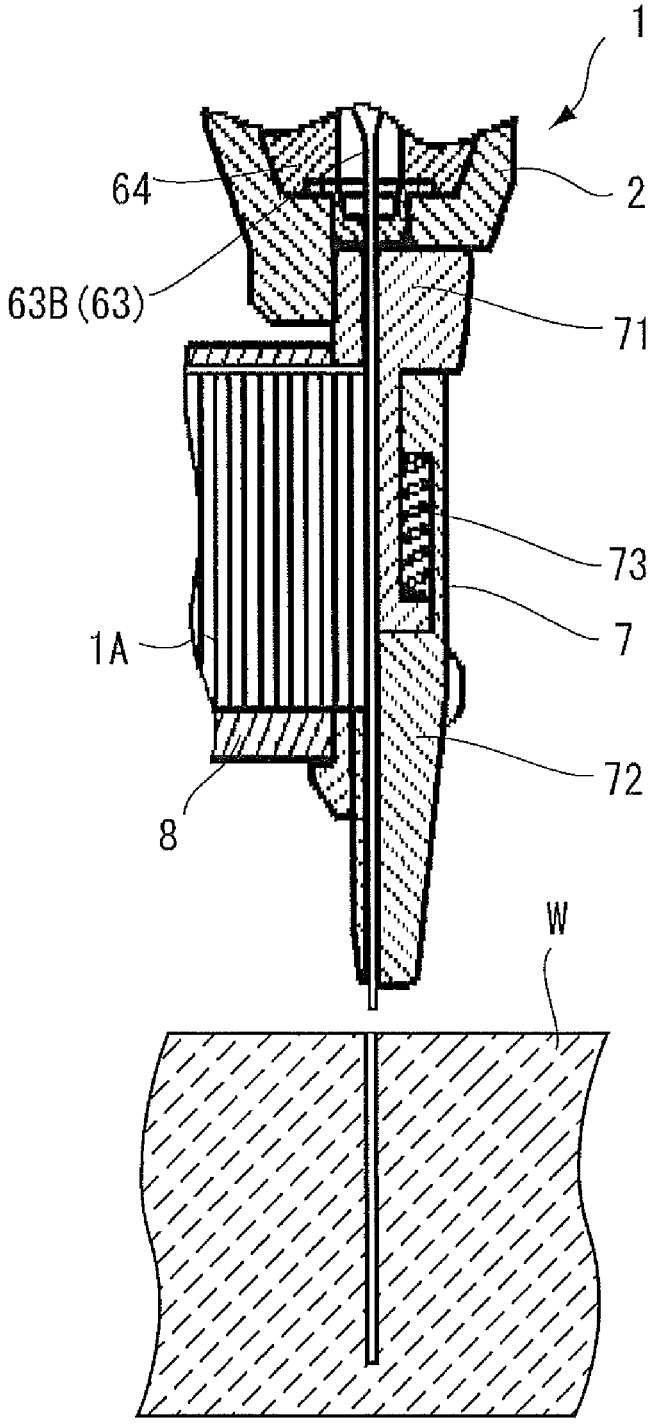
FIG. 5C is a cross-sectional view showing a periphery of a nose portion in a state after the nail driving operation.

Further, as shown in FIG. 5C, the nose 72 moves toward the base 71 by the urging force of the nose urging spring 73, thereby returning to the initial state prior to nail driving operation.

Figure 6:
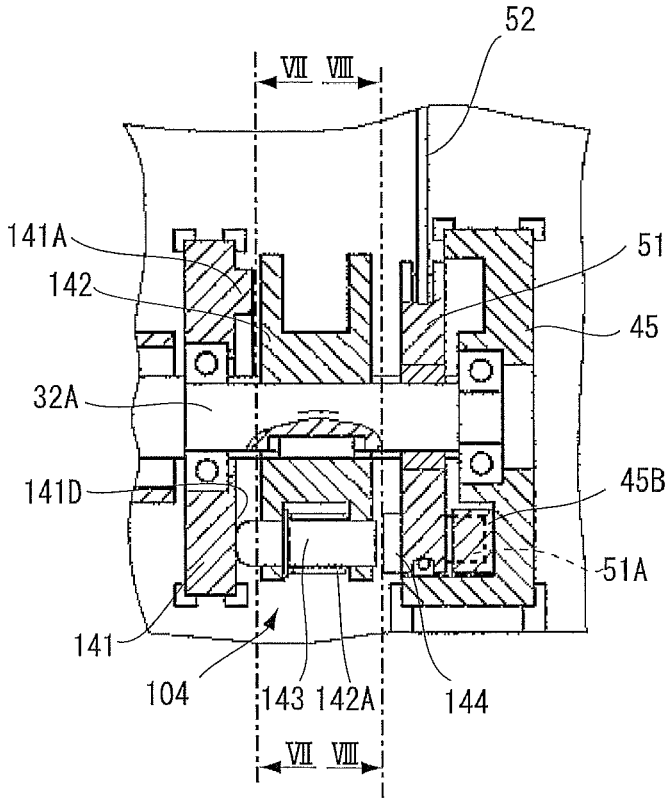
FIG. 6 is a cross-sectional view showing a clutch mechanism according to a modification to the first embodiment.

Next, a clutch mechanism according to a modification to the embodiment of the present invention will be described with reference to FIGS. 6 through 9. As shown in FIG. 6, the clutch mechanism 104 includes a guide plate 141, a pin supporting portion 142, a power transmission pin 143, and a drum hook 144 provided on the drum 51.

Figure 7:
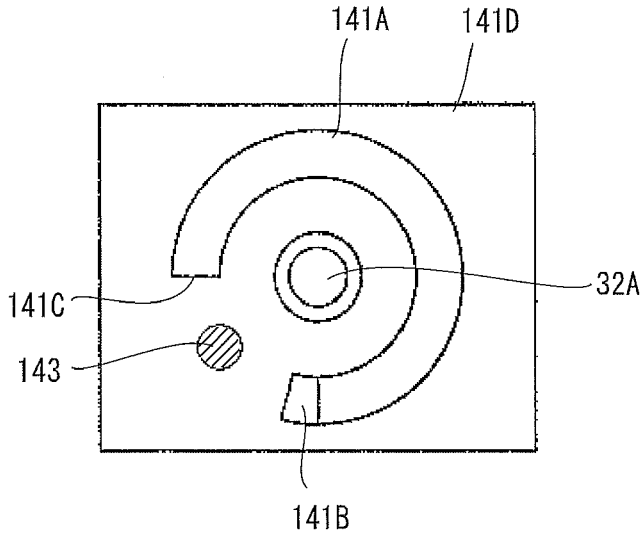
FIG. 7 is a cross-sectional view taken along a line VII-VII in FIG. 6.

As shown in FIGS. 6 and 7, the guide plate 141 is fixed to the housing 2 and has a guide surface 141D which faces the pin supporting portion 142 and contacts with one end portion of the power transmission pin 143. A rail portion 141A protrudes from the guide surface 141D toward the drum 51 and extends along a trajectory of the power transmission pin 143, circularly moving on the guide surface 141D of the guide plate 141, in a range of 270 degrees. Further, one end portion of the rail portion 141A has a slant surface 141B and another end portion of the rail portion 141A has a plane end surface 141C perpendicular to the guide surface 141D.

The pin supporting portion 142 having a substantially disk shape is located at a position opposite to the driving portion 3 with respect to the guide plate 141, and is coaxially rotatably fixed with the output shaft 32A by a key. Further, the pin supporting portion 142 includes a pin urging spring 142A that urges the power transmission pin 143 toward the guide plate 141.

The power transmission pin 143 is movably supported in a direction parallel to the central axis of the output shaft 32A by the pin supporting portion 142 so that the one end portion of the power transmission pin 43 faces the guide plate 141 and another end portion of the power transmission pin 143 faces the drum 51. Further, the power transmission pin 143 is urged by the pin urging spring 142A toward the guide plate 141. Thus, the one end portion of the power transmission pin 143 consistently contacts with the guide plate 141.

The drum 51 is located at a position opposite to the guide plate 141 with respect to the pin supporting portion 142. The drum hook 144 is provided on a surface of the drum 51, the surface facing the pin supporting portion 142. Further, the drum hook 144 is capable of engaging with the other end of the power transmission pin 143 while the power transmission pin 143 is positioned on the rail portion 141A.

Figure 8:
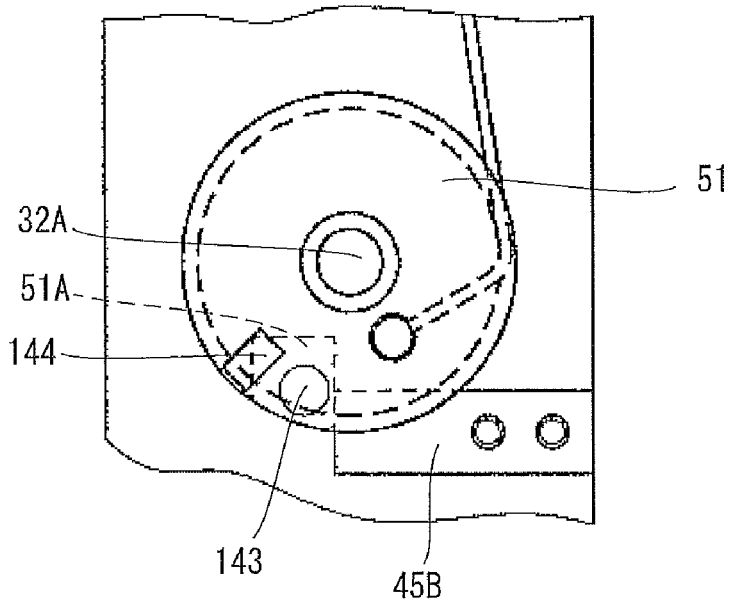
FIG. 8 is a cross-sectional view taken along a line VIII-VIII in FIG. 6.
Figure 9:
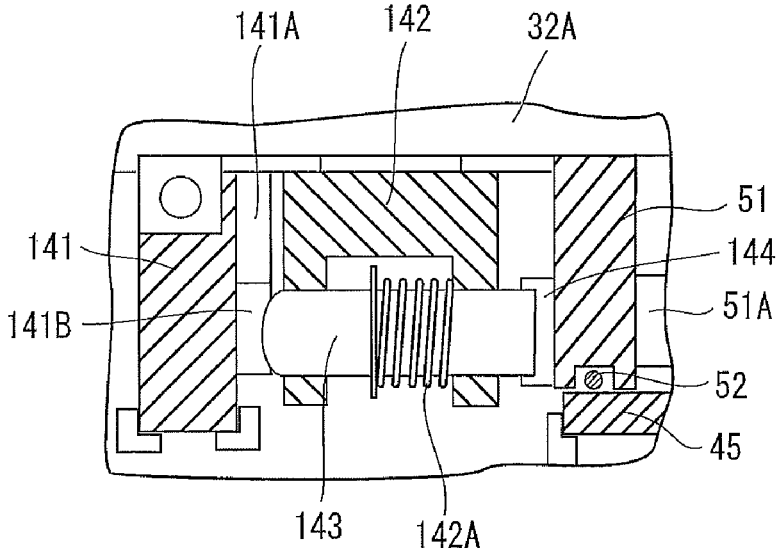
FIG. 9 is a view showing a state where the power transmission pin of the clutch mechanism is moved over a rail portion.

As shown in FIG. 8, in order to rotate the drum 51, the output shaft 32A and the pin supporting portion 142 are rotated, and the one end of the power transmission pin 143 is moved over the rail portion 141A. At this moment, the one end of the power transmission pin 143 slides the slant surface 141B and moves over the rail portion 141A. Upon moving the power transmission pin 143 over the rail portion 141A, the other end of the power transmission pin 143 projects toward the drum 51. In this state, as shown in FIGS. 8 and 9, the other end of the power transmission pin 143 latches with the drum hook 144 by rotating the pin supporting portion 142, thereby rotating the drum 51 together with the output shaft 32A and the pin supporting portion 142.

Upon rotating the output shaft 32A by 270 degrees and positioning the plunger 63 at the top dead center, the one end of the power transmission pin 143 reaches the plane end surface 141C. Since the power transmission pin 143 is urged by the pin urging spring 142A toward the guide plate 141, the one end of the power transmission pin 143 moves from the rail portion 141A to the guide surface 141D, thereby releasing the other end of the power transmission pin 143 from the drum hook 144. Thus, the drum 51 becomes freely rotatable, thereby releasing the compressed coil spring 62, and impacting and driving the nail 1A by the blade 63B of the plunger 63.

Figure 10:
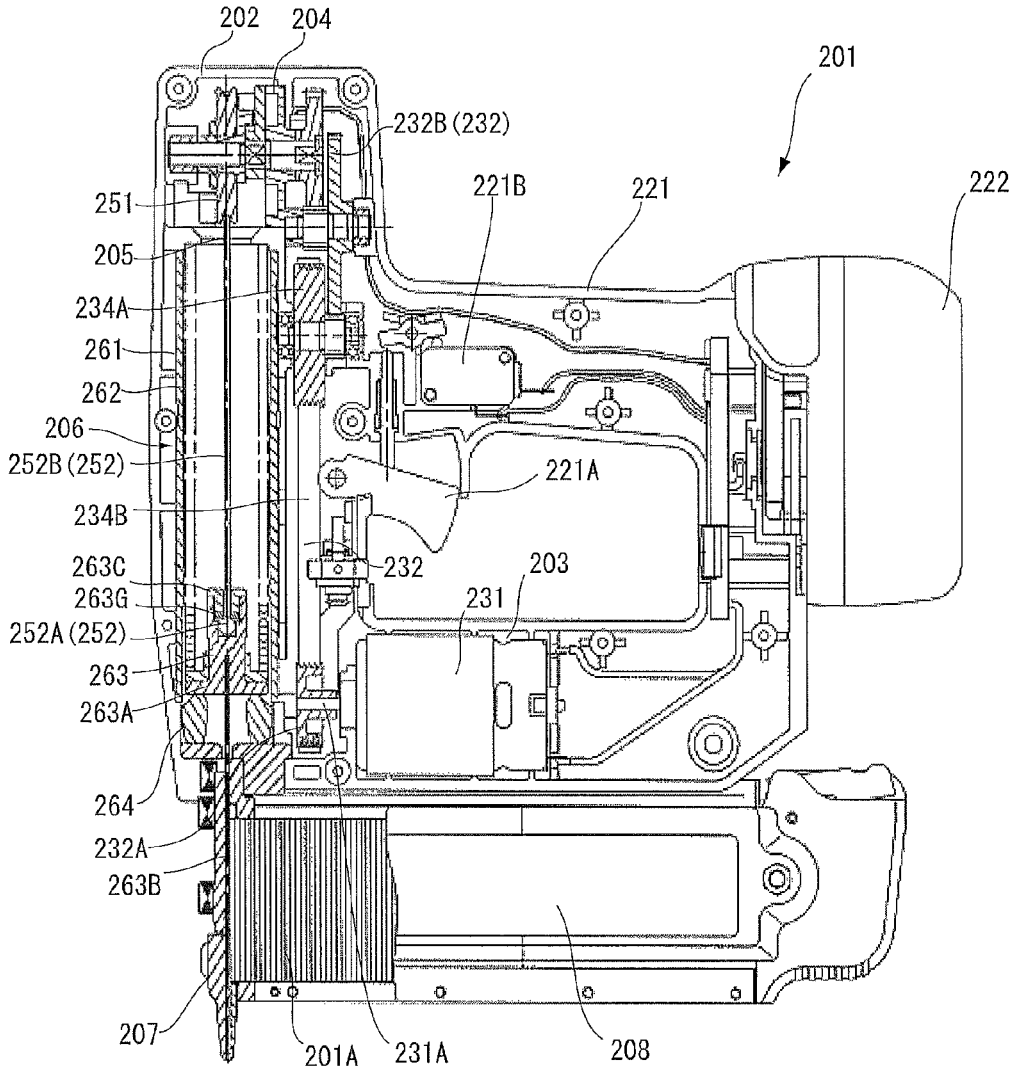
FIG. 10 is a cross-sectional view of a fastener driving tool according to a second embodiment of the present invention.

Next, a fastener driving tool according to a second embodiment of the present invention will be described with reference to FIGS. 10 and 13. As shown in FIG. 10, in the nail gun 201 according to the second embodiment, a drum 251 of a transmission portion 205 is driven to rotate by a motor 231 via a clutch mechanism 204, thereby winding a cable 252 and moving a plunger 263 to the top dead center against an urging force of a coil spring 262. Subsequently, the drum 251 is released by the clutch mechanism 204 so that the plunger 263 moves toward the bottom dead center and a nail 201A supplied from a magazine 208 to a nose 207 is impacted. Accordingly, the fastener driving tool 201 according to the second embodiment has substantially the same configuration as the fastener driving tool 1 according to the first embodiment. Therefore, description with respect to like parts and components that are the same as those of the first embodiment will be omitted, and only different aspects will be described.

A switch 221B is provided near a trigger 221A of a handle 221 in a housing 202. The switch 221B is connected to a battery 222. Upon pulling the trigger 221A, the switch 221B turns on to start electric power supply to the motor 231 from the battery 222.

A decelerating mechanism 232 is disposed between the motor 231 and the clutch mechanism 204 in a driving portion 203. The decelerating mechanism 232 includes a pulley 232A, a plurality of gears 232B, a pulley 234A, and a belt 234B. The pulley 232A is connected to a driving shaft 231A. The plurality of gears 232B is disposed between the pulley 234A and the clutch mechanism 204. The belt 234B is mounted over the pulley 232A and the pulley 234A. Rotation of the driving shaft 231A of the motor 231 is deceleratingly transmitted to the clutch mechanism 204 by the decelerating mechanism 232.

The clutch mechanism 204 has the configuration the same as that of the clutch mechanism 4 of the first embodiment. Thus, a connection between the drum 251 and clutch mechanism 204 is shut-off after the drum 251 rotates predetermined degrees that are degrees of rotation of the drum 251 for moving upwardly the plunger 263 from the bottom dead center to the top dead center.

The drum 251 is disposed in the housing 202 coaxially with the clutch mechanism 204 in the transmission portion 205. Further, the drum 251 is disposed in the housing 202 in such a manner that a tangent line of an outer circumference of the drum 251, the tangent line being coincident with the cable 252 wound over the outer circumference, substantially coincides with a central axis of a spring guide 261. Accordingly, the cable 252 can be wound along an axis of the spring guide 261, thereby moving the plunger 263 toward the top dead center. Further, a guide pulley for guiding the cable 252 is not required when the drum 251 winds the cable 252. Therefore, a resistance force applied during pulling up the plunger 263 can be reduced.

The cable 252 connected to the drum 251 has a retained portion 252A and a cable portion 252B. The retained portion 252A is formed in a substantially spherical shape having a diameter larger than that of the cable portion 252B. The retained portion 252A is fixed to one end of the cable portion 252B, the one end of the cable portion 252B being opposite to another end of the cable portion 252B connected to the drum 251. A retained portion (not shown) is also provided on the other end of the cable portion 252B and is formed in a substantially spherical shape the same as that of the retained portion 252A. The retained portion (not shown) is retained by the drum 251. The cable portion 252B has fibrous steel wires bundled together as a wire bundle. A surface of the wire bundle is coated with a resin.

A coil spring portion 206 is provided which includes a spring guide 261, a coil spring 262, and a plunger 263. The spring guide 261 is provided below the drum 251. The coil spring 262 is inserted into the spring guide 261. The plunger 263 is urged by the coil spring 262.

Figure 11:
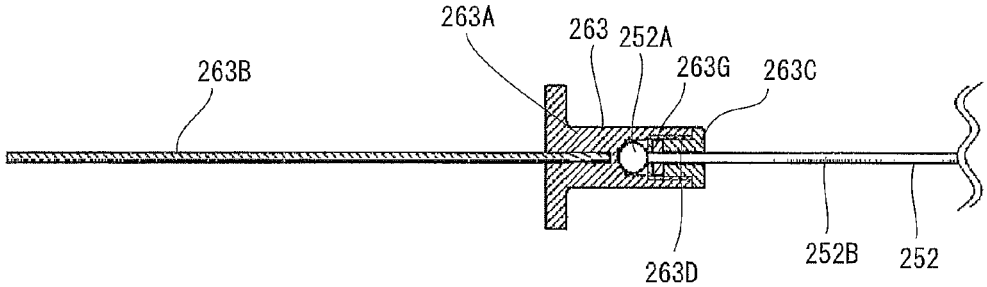
FIG. 11 is a cross-sectional view showing a plunger of the fastener driving tool according to the second embodiment.

As shown in FIG. 11, the plunger 263 includes an urging main body 263A, a blade 263B, and a retaining portion 263C. The urging main body 263A is made from resin and integrally formed with the blade 263B. One end of the urging main body 263A opposite to the blade 263B is formed with a recess. An inner surface of the recess is provided with an engaged portion (female thread) 263D. The engaged portion 263D is formed with a thread groove thredingly engaged with the retaining portion 263C.

Figure 12:
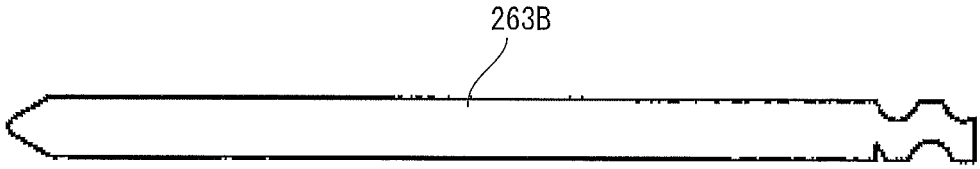
FIG. 12 is a plan view showing a blade of the fastener driving tool according to the second embodiment.

As shown in FIG. 12, the blade 263B is an elongated plate. One end of the blade 263B has a meander shape. The one end of the blade 263B is embedded into the urging main body 263A to become integral with the urging main body 263A. Thus, the one end of the blade 263B can be fixedly retained by the urging main body 263A.

Figure 13:
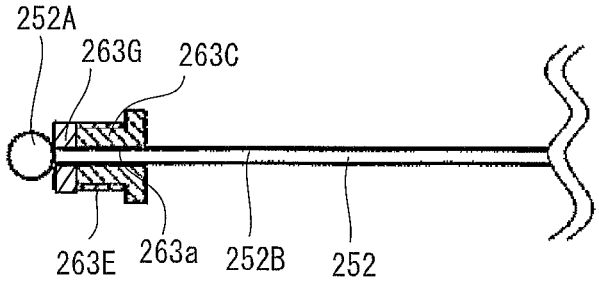
FIG. 13 is a cross-sectional view showing a cable and a retained portion of the fastener driving tool according to the second embodiment.

As shown in FIG. 13, the retaining portion 263C is formed in a substantially cylindrical cap shape and is formed with a through-hole 263*a*. The cable portion 252B is inserted into the through-hole 263*a*. Thus, the retained portion 252A can be retained by the retaining portion 263C. Outer periphery of the retaining portion 263C is provided with an engaging portion (male thread) 263E. The engaging portion 263E is formed with a thread thredingly engaged with the engaged portion 263D, resulting in connecting the retaining portion 263C with the urging main body 263A. As shown in FIGS. 11 and 13, a buffer 263G made from a rubber is interposed between the retained potion 252A and the retaining portion 263C. Thus, the plunger 263 is connected to the cable 252 via the buffer 263G. Accordingly, the buffer 263G can absorb impacts when rapidly urging the plunger 263 by the coil spring 262 and driving the nail 201A, and can suppress transmissions of the impact to the cable 252, the clutch mechanism 204, and another mechanism related to driving the nail gun 201, thereby prolonging service life of the nail gun 201.

Since the connection between the retaining portion 263C and the urging main body 263A is attained by threding engagement between the engaging portion 263E and the engaged portion 263D, the urging main body 263A can be replaced easily by a new urging main body if the urging main body 263A or the blade 263B is damaged. A bumper 264, made from a resin such as a flexible rubber, a urethane and the like, is provided below the urging main body 263A.

When the nail 201A is driven by the above-described nail gun 201, a user pulls the trigger 211A to turn on the switch 221B and to electrically connect the battery 222 to the motor 231, thereby supplying electric power to the motor 231. Thus, driving force of the motor 231 is transmitted to the clutch mechanism 204 to rotate the drum 251 by way of the pulleys 232A and 234A, belt 234B, and the plurality of gears 232B.

Upon winding the cable portion 252B by rotation of the drum 251, the plunger 263 including the retaining portion 263C is pulled upwardly by the retained potion 252A, thereby integrally moving the retained potion 252A and the plunger 263 toward the top dead center.

The connection between the drum 251 and the motor 231 is shut-off by the clutch mechanism 204 after the plunger 263 has moved to the top dead center. Accordingly, a force for pulling the plunger 263 toward the top dead center is shut-off and the plunger 263 is moved toward the bottom dead center for driving the nail 201A by the biasing force of the coil spring 262. When driving the nail 201A, the plunger 263 is stopped rapidly. Therefore, since the cable 252 is rapidly brought into a loose state from a tension state, an impact may be generated on the cable 252 and the cable 252 may be deteriorated. However, since the buffer 263G is interposed between the cable 252 and the plunger 263, the buffer 263G can absorb the impact to avoid deterioration of the cable 252.

Figure 14:
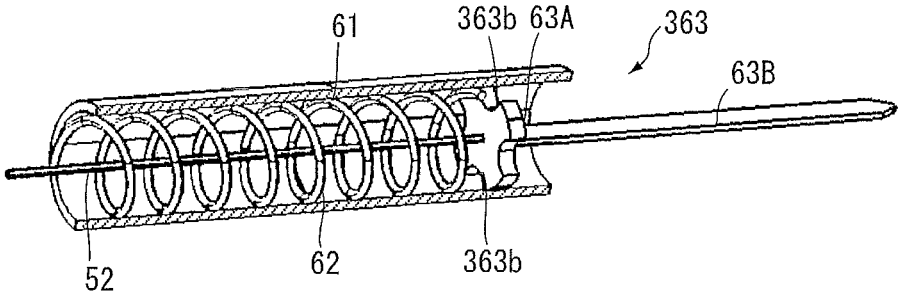
FIG. 14 is a perspective view showing a periphery of a spring guide according to a first modification to the embodiments.

While the invention has been described in detail with reference to specific embodiment thereof, it would be apparent to those skilled in the art that various changes and modifications may be made therein without departing from the scope of the invention. For example, as shown in FIG. 14, a plunger 363 according to a modification may be formed with a plurality of grooves 363*b*. The plurality of grooves 363*b* is open on the first space and the second space of the spring guide 61. With this structure, the first space and the second space can be in fluid communication with each other via the plurality of grooves 363*b*. Therefore, the air damper effect can be prevented.

Figure 15:
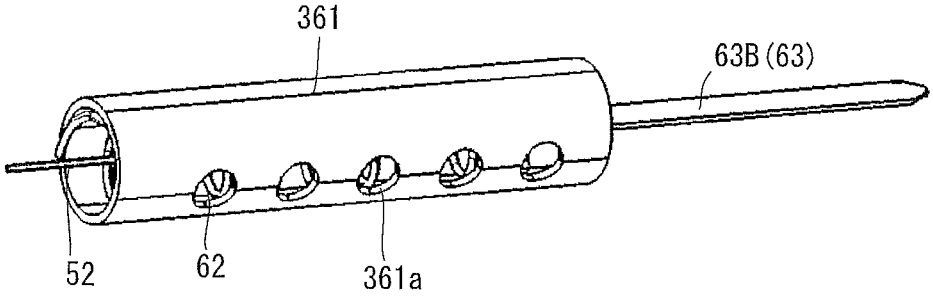
FIG. 15 is a perspective view showing a periphery of a spring guide according to a second modification to the embodiments.

Further, as shown in FIG. 15, a spring guide 361 according to another modification may be formed with a plurality of though-holes 361*a*. A space in the spring guide 361 is in fluid communication with outside air via the plurality of through-holes 361*a*.

As described above, the inner peripheral surface of the spring guide 61 is coated with the ultrahigh molecular weight polyethylene layer. However, a polyethylene, a polypropylene, a polyacetal, a fluorine resin or the like is also available as the coating material. These materials can also reduce a sliding resistance between the spring guide 361 and the coil spring 62.

Figure 16:
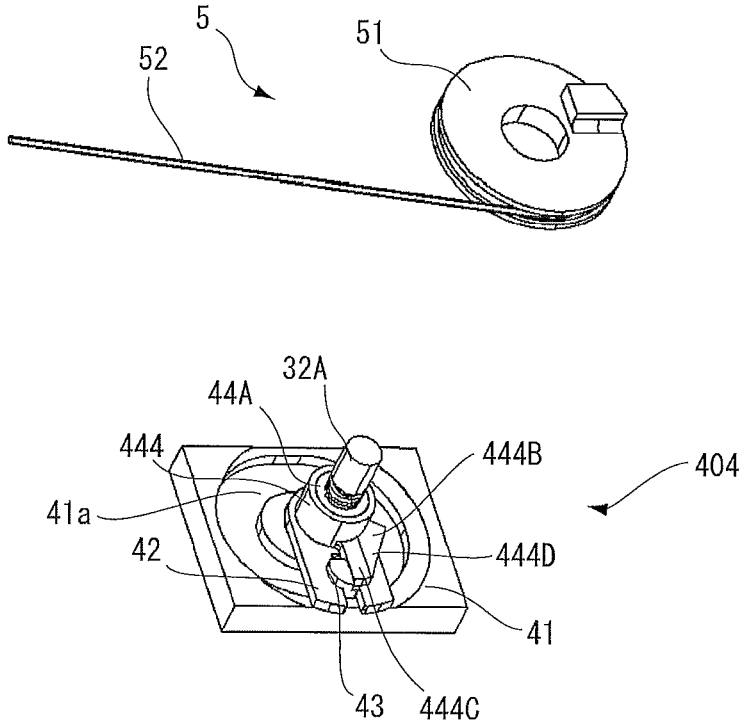
FIG. 16 is an exploded perspective view showing a clutch mechanism of the fastener driving tool according to a modification to the first embodiment.

Further, as shown in FIG. 16, a clutch mechanism 404 according to a modification to the first embodiment may include a drum hook 444 having a hook portion 444B. The hook portion 444B may include a first portion 444C made from a metal and a second portion 444D made from a resin having a density lower than that of the metal. The first portion 444C slidably contacts the power transmission pin 43 when the output shaft 32A rotates. Since the first portion 444C is made from the metal, the first portion 444C has an abrasion resistance against the power transmission pin 43. Further, since the second portion 444D is made from the resin, the drum hook 444 can have a lightweight structure.

Accordingly, the nail gun 1 and a portion which rotates with the drum 51 to be pulled by the cable 52 in the nail driving operation, can have a lightweight structure, thereby improving a response of the drum hook 444 in the nail driving operation. That is, the drum hook 444 can easily return to the initial position after the nail driving operation.

Figure 17:
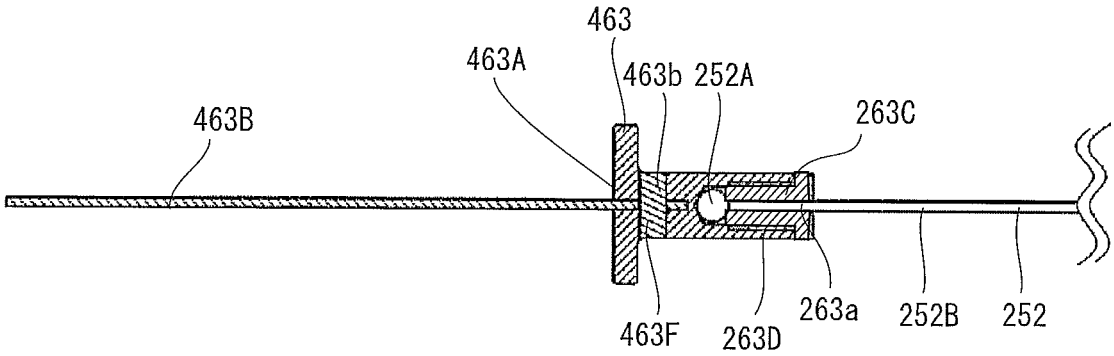
FIG. 17 is a cross-sectional view showing a plunger of the fastener driving tool according to a modification to the second embodiment.
Figure 18:
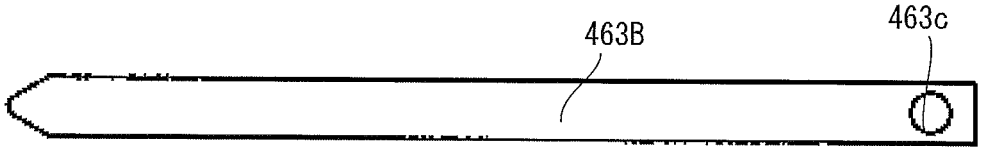
FIG. 18 is a plan view showing a blade of the fastener driving tool according to a modification to the second embodiment.

Further, as shown in FIG. 17, a plunger 463 according to a modification to the second embodiment includes an urging main body 463A, a blade 463B and a pin 463F. The urging main body 463A and the blade 463B are connected by the pin 463F. The urging main body 463A is formed with a through-hole 463*b* through which the pin 463F is inserted. As shown in FIG. 18, the blade 463B is formed with a through-hole 463*c* through which the pin 463F is inserted. Accordingly, the pin 463F is inserted into the through-holes 463*b* and 463*c* in a state that the blade 463B is attached to the urging main body 463A, thereby fixing the blade 463B with the urging main body 463A. Therefore, the blade 463B can be easily replaced by a new blade by pulling the pin 463F from the through-holes 463*b* and 463*c*, if the blade 463B is damaged such as bending.

Figure 19:
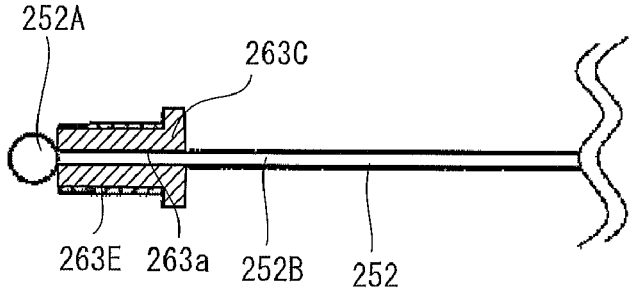
FIG. 19 is a cross-sectional view showing a cable and a retained portion of the fastener driving tool according to a modification to the second embodiment.

Further, as shown in FIGS. 17 and 19, the retained portion 252A may be directly retained by the retaining portion 263C.

Figure 20:
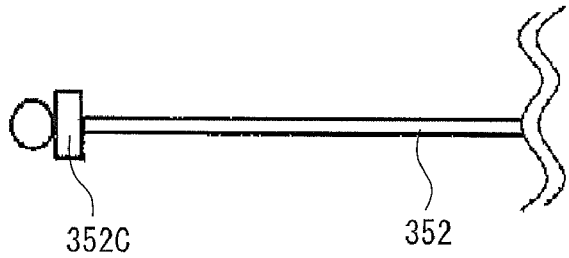
FIG. 20 is a plan view showing a buffer mechanism integrally provided on a cable of the fastener driving tool according to a modification to the second embodiment.
Figure 21:
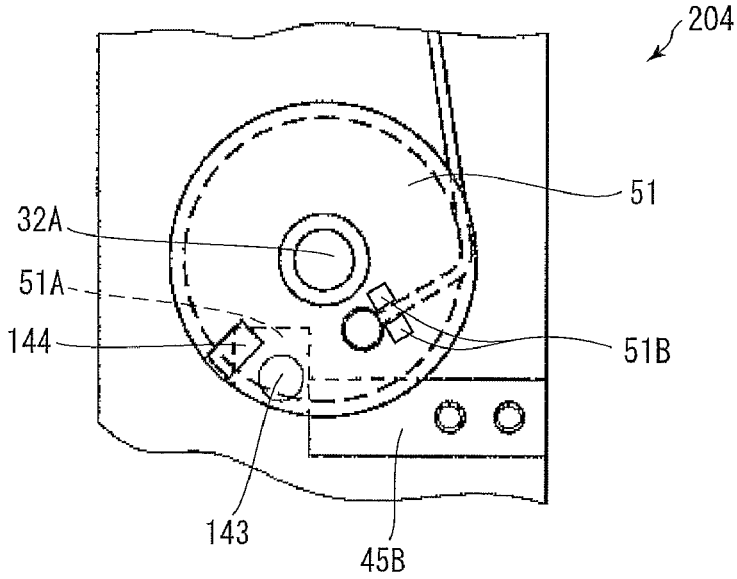
FIG. 21 is a view showing a buffer mechanism provided on a clutch mechanism of the fastener driving tool according to a modification to the second embodiment.

Further, a buffer mechanism (the buffer 263G) of the second embodiment is provided between the retained potion 252A, which is one end portion of the cable 252, and the retaining portion 263C, which is a connecting portion of the plunger 263 and the cable 252. However, as shown in FIGS. 20 and 21, the buffer mechanism 352C and 51B may be provided on a middle portion of the cable 352 or in the clutch mechanism 204. The buffer mechanism 352C is integrally provided on the cable 352. That is, the buffer mechanism can absorb the impact of the nail gun 201 as long as the buffer mechanism is provided in a mechanism for driving the nail gun 201. The cables 52 and 252 have the fibrous steel wires as the wire bundle, respectively. However, a sheet member having fibrous steel wires bundled together may be used for pulling the plunger 63 and 263 in place of the cables 52 and 252. A surface of the sheet member is coated with a resin.

Further, the drums according to the above-described embodiments are made from a metal. However, the drums may be made from a resin for having a lightweight structure and improving the impact force or an acceleration of the plunger.

The invention claimed is:

1. A fastener driving tool comprising:

a housing;

a motor provided in the housing;

a plunger provided in the housing for impacting a fastener in a fastener driving direction;

a spring urging the plunger in the fastener driving direction;

a drum driven by the motor to rotate around an axis; and one of a cable and a sheet member capable of being wound over the drum and having one end fixed to the drum and another end acting on the spring for transmitting a driving force of the motor to the spring, wherein the spring is configured to accumulate a resilient energy therein for impacting the fastener by the plunger, the resilient energy of the spring being accumulated by forcible resilient deformation thereof as a result of winding of the one of the cable and the sheet member over the drum rotationally driven by the motor.

2. The fastener driving tool according to claim 1, wherein the one of the cable and the sheet member is connected to the plunger, wherein the resilient energy of the spring is accumulated therein as a result of pulling the plunger by the one of the cable and the sheet member.

3. The fastener driving tool according to claim 1, wherein the one of the cable and the sheet member has a bundle of fibers.

4. The fastener driving tool according to claim 3, wherein the fibers are made from metal.

5. The fastener driving tool according to claim 4, wherein the one of the cable and the sheet member has a surface coated with a resin.

6. The fastener driving tool according to claim 1, further comprising a clutch provided between the motor and the drum, the clutch being movable between a transmission position where the driving force of the motor is transmitted to the drum and a shut-off position where transmission of the driving force of the motor to the drum is shut-off.

7. The fastener driving tool according to claim 1, further comprising a power transmission mechanism positioned between the motor and the drum for transmitting a driving force of the motor to the drum, the power transmission mechanism comprising a planetary gear mechanism.

8. The fastener driving tool according to claim 7, wherein the spring has a displacement for accumulating the resilient energy therein, the displacement being less than a circumference length of the drum.

9. A fastener driving tool comprising:

a housing;

a motor provided in the housing;

a plunger provided in the housing for impacting a fastener in a fastener driving direction;

a spring urging the plunger in the fastener driving direction;

a drum rotatably supported in the housing and rotationally driven by the motor;

one of a cable and a sheet member capable of being wound over the drum and having one end fixed to the drum and another end acting on the spring for transmitting a driving force of the motor to the spring; and a clutch provided between the motor and the drum, the clutch being movable between a transmission position where the driving force of the motor is transmitted to the drum and a shut-off position where transmission of the driving force of the motor to the drum is shut-off;

wherein the spring is configured to accumulate a resilient energy therein for impacting the fastener by the plunger, the resilient energy of the spring being accumulated by forcible resilient deformation thereof as a result of winding of the one of the cable and the sheet member over the drum rotationally driven by the motor; and wherein the clutch comprises a power transmission pin movable between the transmission position and the shut-off position, the drum and the motor being connected to integrally rotate with each other via the power transmission pin at the transmission position of the power transmission pin.

10. The fastener driving tool according to claim 9, wherein the clutch further comprises a pin guide for guiding movement of the power transmission pin between the transmission position and the shut-off position, the pin guide being configured to guide the movement of the power transmission pin between the transmission position and the shut-off position in accordance with a rotational position of the drum.

11. The fastener driving tool according to claim 9, wherein the clutch further comprises a first member and a second member supporting the first member, the first member contacting the power transmission pin at the transmission position and separating from the power transmission pin at the shut-off position, the first member and the second member being made from materials different from each other.

12. The fastener driving tool according to claim 11, wherein the first member and the second member are connected to the plunger.

13. The fastener driving tool according to claim 11, wherein the second member has a density lower than that of the first member.

14. A fastener driving tool comprising:

a housing;

a motor provided in the housing;

a plunger provided in the housing for impacting a fastener in a fastener driving direction;

a spring urging the plunger in the fastener driving direction;

a drum rotatably supported in the housing and rotationally driven by the motor;

one of a cable and a sheet member capable of being wound over the drum and having one end fixed to the drum and another end acting on the spring for transmitting a driving force of the motor to the spring, a power transmission mechanism positioned between the motor and the drum for transmitting a driving force of the motor to the drum, the power transmission mechanism comprising a planetary gear mechanism;

wherein the spring is configured to accumulate a resilient energy therein for impacting the fastener by the plunger, the resilient energy of the spring being accumulated by forcible resilient deformation thereof as a result of winding of the one of the cable and the sheet member over the drum rotationally driven by the motor; and wherein the drum includes a latching portion and the housing includes a latched portion, the latching portion and the latched portion being configured to latch with each other in a state that the drum is positioned at an angular initial rotational position where the drum is about to wind the one of the cable and sheet member.

15. A fastener driving tool comprising:

a housing;

a motor provided in the housing;

a plunger provided in the housing for impacting a fastener in a fastener driving direction;

a spring urging the plunger in the fastener driving direction;

a drum driven by the motor to rotate around an axis;

one of a cable and a sheet member capable of being wound over the drum and having one end fixed to the drum and another end connected to the spring, the spring being configured to accumulate a resilient energy as a result of winding of the one of the cable and the sheet member over the drum; and a clutch selectively transmitting a driving force of the motor to the drum.

16. A fastener driving tool comprising:

a housing;

a motor provided in the housing;

a plunger provided in the housing for impacting a fastener in a fastener driving direction;

a drum driven by the motor to rotate around an axis;

a cable wound over the drum and having a first portion fixed to the drum and extending in a direction parallel with the fastener driving direction and a second portion connected to the plunger and extending in a direction opposite to the fastener driving direction;

a spring disposed around the second portion of the cable and configured to accumulate a resilient energy as a result of winding of the cable over the drum; and a clutch selectively transmitting a driving force of the motor to the drum.

* * * * *